US007788742B2

(12) United States Patent
England

(10) Patent No.: US 7,788,742 B2
(45) Date of Patent: Sep. 7, 2010

(54) CISTERN OUTLET VALVE ASSEMBLY

(75) Inventor: Sam Robertson England, Teringie (AU)

(73) Assignee: Caroma Industries Limited, Brisbane, Queensland (AU)

( * ) Notice: Subject to any disclaimer, the term of this patent is extended or adjusted under 35 U.S.C. 154(b) by 1116 days.

(21) Appl. No.: 10/527,095

(22) PCT Filed: Aug. 28, 2003

(86) PCT No.: PCT/AU03/01105

§ 371 (c)(1),
(2), (4) Date: Oct. 26, 2005

(87) PCT Pub. No.: WO2004/027172

PCT Pub. Date: Apr. 1, 2004

(65) Prior Publication Data

US 2006/0137083 A1 Jun. 29, 2006

(30) Foreign Application Priority Data

Sep. 19, 2002 (AU) ..... 2002951502

(51) Int. Cl.
*E03D 1/35* (2006.01)

(52) U.S. Cl. ..... 4/398; 4/397; 4/403; 251/330

(58) Field of Classification Search ..... 4/391, 4/397, 398, 403; 251/284, 330, 333
See application file for complete search history.

(56) References Cited

U.S. PATENT DOCUMENTS 2,218,871 A * 10/1940 Broden ..... 251/333
4,385,406 A * 5/1983 Miskiewicz ..... 4/378
4,656,677 A 4/1987 Miskiewicz

FOREIGN PATENT DOCUMENTS

| | | |
|---|---|---|
| FR | 2 580 694 | 4/1985 |
| FR | 2 669 058 | 11/1990 |
| FR | 2 669 356 | 11/1991 |
| FR | 2 727 706 | 12/1994 |

* cited by examiner

*Primary Examiner*—Robert M Fetsuga
(74) *Attorney, Agent, or Firm*—Merchant & Gould P.C.

(57) ABSTRACT

A cistern outlet valve assembly (10). The assembly includes an outlet orifice (14) and a buoyant member (20). The buoyant member (20) has an outlet seal (22) on one side and a housing seal (26) on the other. The assembly (10) also includes a valve housing (18) is adapted to cover the buoyant member (20). The housing (18) has large clearance guide means (30) adapted to guide movement of the buoyant member (20) from a closed position in which the outlet seal (22) seals against the outlet orifice (14) and an open position in which the housing seal (20) seals against the housing (18). When the buoyant member (20) is in the open position any fluid incident on the guide means (30) is prevented from flowing onto the buoyant member (20) by the housing seal (20) sealing against the housing (18).

12 Claims, 3 Drawing Sheets

CISTERN OUTLET VALVE ASSEMBLY

TECHNICAL FIELD

The present invention relates to a cistern outlet valve assembly. A cistern is known as a flush tank in the United States of America.

BACKGROUND OF THE INVENTION

One type of known cistern outlet valve is termed a buoyant outlet valve (sometimes referred to as a float valve). A buoyant outlet valve requires a very close tolerance (ie between the housing that fits over the top of the float and the guide shaft that runs through this housing and constrains the movement of the float). The close tolerance is necessary in order to restrict any water incident on the housing from flowing onto the top of the float. Any such water on the float places a positive pressure on the top face of the float and can result in the valve closing prematurely or at a higher level than is desired.

A disadvantage with valves of this type is that the close tolerance required between the housing and the float shaft is expensive and difficult to produce and does not provide a very efficient fluid seal. Further, the housing and the shaft are generally moulded from plastic materials and small moulding variations can lead to jamming of the valve, poor valve performance or premature wear between the contacting faces.

OBJECT OF THE INVENTION

It is the object of the present invention to substantially overcome or at least ameliorate one or more of the above prior art disadvantages.

SUMMARY OF THE INVENTION

A cistern outlet valve assembly, the assembly including:

an outlet orifice;

a buoyant member with an outlet seal on one side and a housing seal on the other; and a valve housing adapted to cover the buoyant member and having a large clearance guide means adapted to guide the movement of the buoyant member from a closed position in which the outlet seal seals against the outlet orifice and an open position in which the housing seal seals against the housing, whereby when the buoyant member is in the open position any fluid incident on the guide means is prevented from flowing onto the buoyant member by the housing seal sealing against the housing.

The housing preferably includes a substantially complimentary annular flat portion against which the housing seal seals in the open position. The housing seal is preferably a raised annular bead on the buoyant member. The guide means is preferably a cylindrical opening in the housing that is adapted to loosely receive a cylindrical extension on the buoyant member therethrough. The bead is preferably circumferential around the end of the extension adjacent the buoyant member. The housing recess is preferably circumferential around the end of the cylindrical opening adjacent the housing.

The buoyant member, the bead and the extension are desirably integrally moulded.

The valve assembly preferably also includes an outlet member having the outlet orifice therein. The outlet member preferably also includes at least one, desirably four, joining members adapted to engage with the housing.

The outlet seal is preferably an annulus formed from a compliant elastomeric material, most preferably rubber.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENTS

Figure 1:
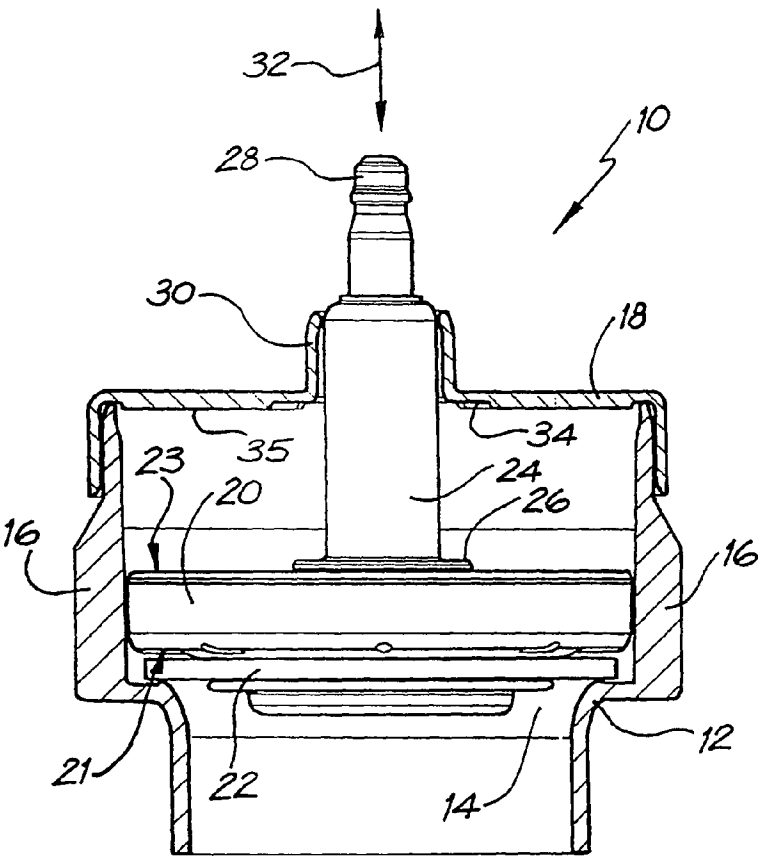
FIG. 1 is a cross sectional side view of an embodiment of a cistern outlet valve assembly according to the invention, in a closed position.

Referring to the drawings, there is shown an embodiment of a cistern outlet valve assembly 10 according to the present invention. Referring firstly to FIG. 1, the assembly 10 includes an outlet member 12 with an outlet orifice 14 therein. The outlet member 12 is mounted in the base of a cistern (not shown) and, during flushing, water is directed from the outlet orifice 14 into the toilet pan.

The outlet member 12 has four equi-angularly spaced apart joining members 16, which are adapted to engage a valve housing 18. The assembly 10 also includes a buoyant member, in the form of hollow float 20. Side 21 of the float 20 has an annular rubber outlet seal 22 mounted thereto. Side 23 of the float 20 has a cylindrical guiding extension 24 extending therefrom. The extension 24 has a seal, in the form of a annular bead 26, around its base, and a connecting formation 28 on its distal end.

The extension 24 passes through a cylinder 30 that forms part of the housing 18. The cylinder 30 guides the movement of cylindrical extension 24 in the directions of double headed arrow 32, as would occur in response to actuation of the valve by various actuation means which are well known in the art. It is important to note that a large clearance exists between the exterior of the cylindrical extension 24 and the interior of the cylinder 30, the relevance of which will be explained in more detail below.

The housing 18 also includes a surface in the form of a flat annular portion 34 adjacent the cylinder 30, which is surrounded by twelve equispaced radially extending protuberances 35.

Figure 2:
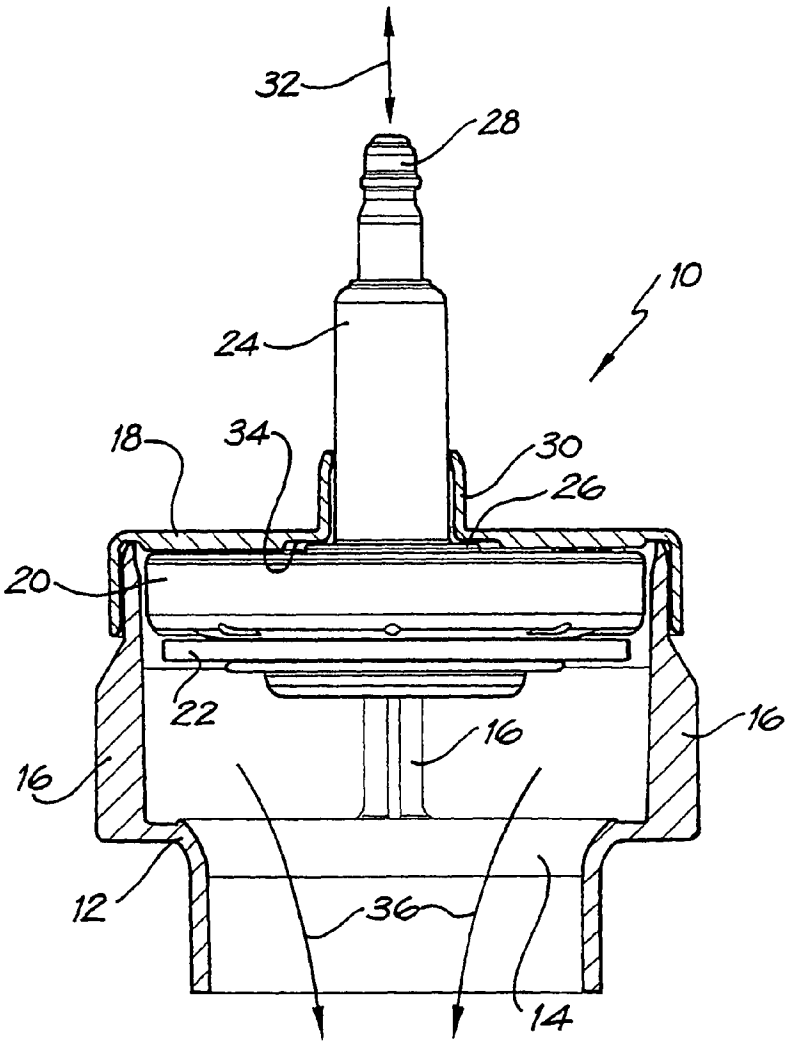
FIG. 2 is a cross sectional side view of the assembly shown in FIG. 1, in an open position.
Figure 3:
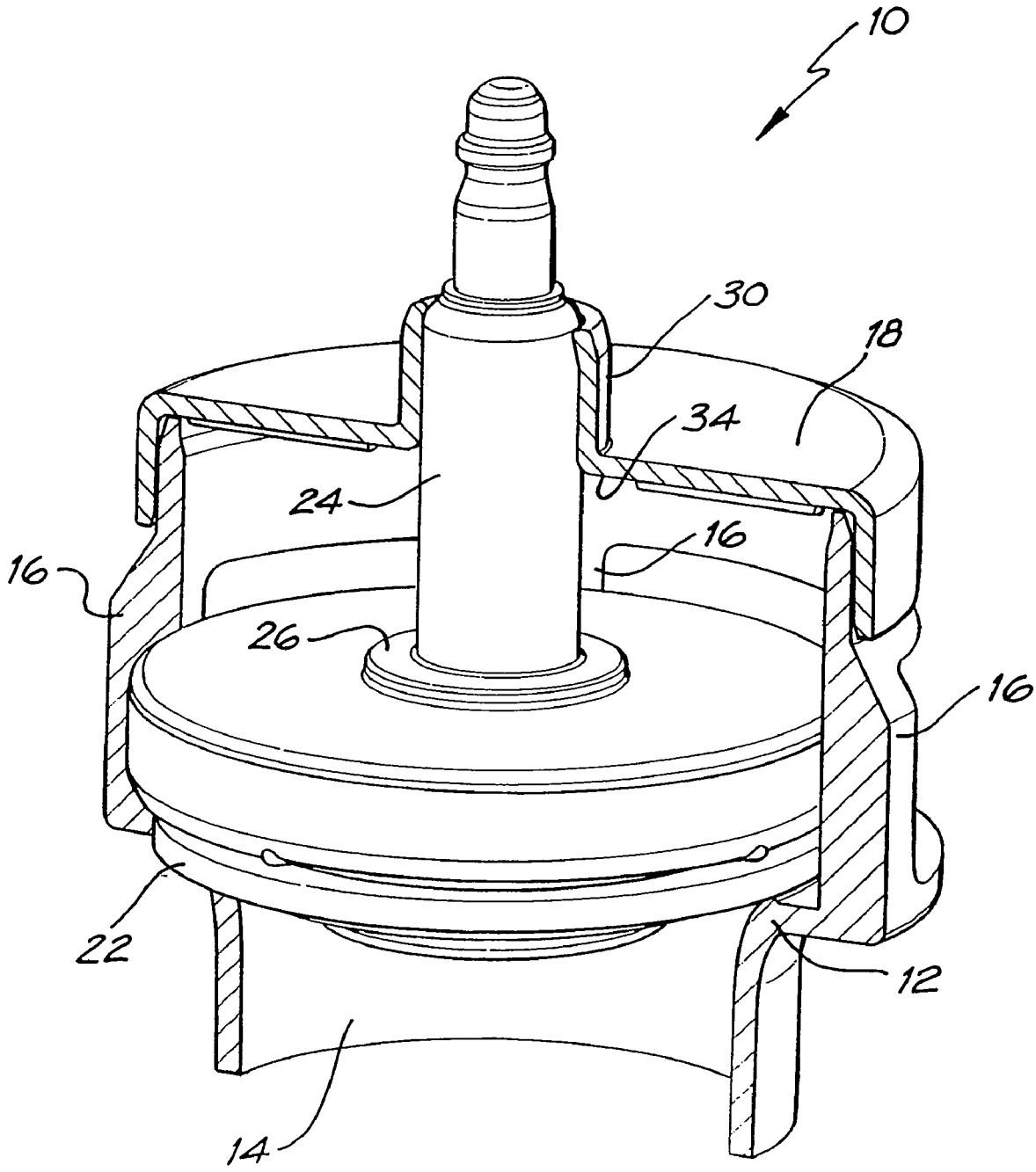
FIG. 3 is a cross sectional perspective view that the valve shown in FIG. 1 is a closed position.
Figure 4:
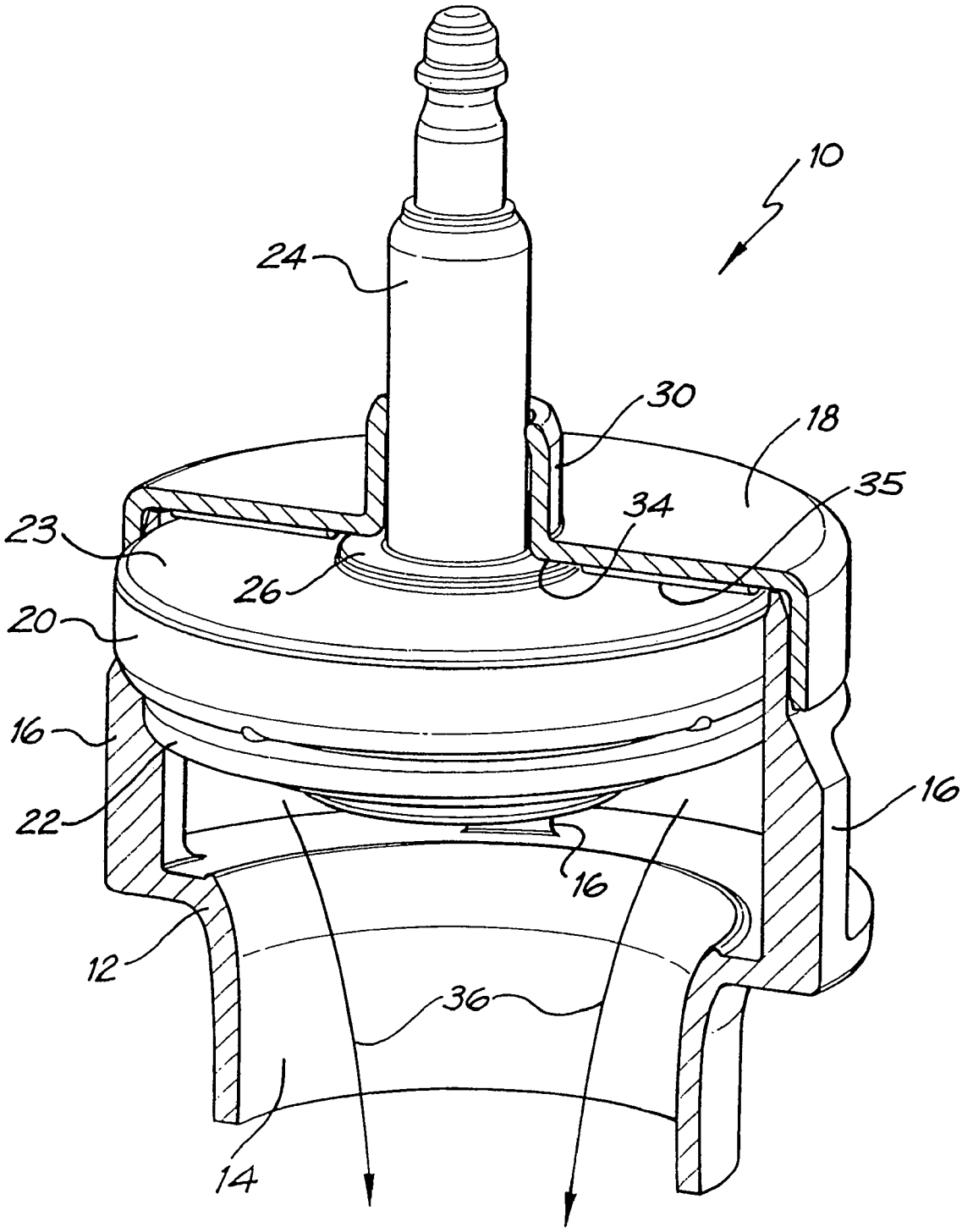
FIG. 4 is a cross sectional perspective view that the valve shown in FIG. 1 is an open position.

The operation of the valve assembly 10 will now be described. FIG. 1 and FIG. 3 show the valve assembly 10 in a closed position in which the outlet seal 22 occludes the outlet orifice 14 such that no water can flow therethrough. To flush the cistern, an actuator connected to the connecting formation 2S raises the float 20 into the open position shown in FIGS. 2 and 4. In this open position, water contained within the cistern flows through outlet orifice 14, as indicated by arrows 36, and so to the cistern pan for flushing.

Whilst the float 20 is in the open position, the head 26 seals against the flat portion 34 of the housing 18, thereby providing a seal between the lower surface of the housing 18 and the upper surface of the float 20. As a result of this seal, any water that is incident on the gap between the cylindrical extension 24 and the cylinder 30 is prevented from flowing onto the float

24. This advantageously avoids the valve closing prematurely under the influence of such water or at a higher level than desired. Whilst in this position, the side 23 of the float 20 is prevented from contacting the housing 18 by the protuberances 35, which avoids the float 20 adhering to the housing 18 due to water tension therebetween.

Further, as the aforementioned seal prevents water flowing on top of the float 20, then the close tolerance between the cylinder 28 and the housing extension 24 (which in the prior art was used to form the seal) is no longer necessary and both the cylindrical extension 24 and the housing 18 can be produced at lower expense with low tolerances and having a high clearance. The high clearances results in the components being much less likely to be influenced by moulding variations, much less likely to wear or jam and thus improves the reliability of the valve. Finally, the face to face seal between the bead 26 and the flat portion 34 is a considerably better seal than the prior art close tolerance cylindrical seal.

Although the invention has been described with reference to a preferred embodiment, it would be appreciated by those skilled in the art that the invention may be embodied in many other forms.

The claims defining the invention are as follows:

1. A cistern outlet valve assembly, the assembly including:

an outlet orifice;

a buoyant member with an outlet seal on a first side and a raised housing seal bead on a second side opposite the first side, the raised housing seal bead being integrally formed with the buoyant member; and a valve housing adapted to cover the buoyant member and having a large clearance guide means adapted to guide the movement of the buoyant member from a closed position in which the outlet seal seals against an outlet orifice and an open position in which the housing seal bead seals against a substantially flat annular sealing surface of the valve housing, the sealing surface adjacent to a plurality of protuberances formed on the valve housing and extending in an outward radial direction, each of the protuberances engaging the second side of the buoyant member when the buoyant member is in the open position, wherein when the buoyant member is in the open position any fluid incident on the guide means is prevented from flowing onto the buoyant member by the housing seal bead sealing against the housing and the engagement of the protuberances with the second side of the buoyant member prevent adherence between the buoyant member and the valve housing due to water tension.

2. A cistern outlet valve assembly, the assembly including:

an outlet orifice;

a buoyant member with an outlet seal on a first side and a raised housing seal bead on a second side opposite the first side, the raised housing seal bead being integrally formed with the buoyant member; and a valve housing adapted to cover the buoyant member and having a large clearance guide means adapted to guide the movement of the buoyant member from a closed position in which the outlet seal seals against an outlet orifice and an open position in which the housing seal bead seals against a sealing surface of the valve housing, the sealing surface adjacent to a plurality of protuberances formed on the valve housing and extending in a radial direction outwardly from the sealing surface, the protuberances each comprising an elongated engagement surface to engage the second side of the buoyant member when the buoyant member is in the open position, wherein when the buoyant member is in the open position any fluid incident on the guide means is prevented from flowing onto the buoyant member by the housing seal bead sealing against the housing and the engagement of the protuberances with the second side of the buoyant member prevent adherence between the buoyant member and the valve housing due to water tension.

3. The assembly as claimed in claim 2, wherein the sealing surface of the valve housing includes a substantially annular flat portion.

4. The assembly as claimed in claim 2, wherein the housing seal bead is a raised annular bead on the buoyant member.

5. The assembly as claimed in claim 4, wherein the guide means is a cylindrical opening in the housing that is adapted to loosely receive a cylindrical extension on the buoyant member therethrough.

6. The assembly as claimed in claim 4, wherein the housing seal bead is circumferential around the end of the extension adjacent the buoyant member.

7. The assembly as claimed in claim 2, wherein the buoyant member and the extension are integrally moulded.

8. The assembly as claimed in claim 2, wherein the valve assembly also includes an outlet member having the outlet orifice therein.

9. The assembly as claimed in claim 8, wherein the outlet member also includes at least one joining member adapted to engage with the housing.

10. The assembly as claimed in claim 9, wherein the outlet member includes four joining members.

11. The assembly as claimed in claim 2, wherein the outlet seal is an annulus formed from a compliant elastomeric material.

12. The assembly as claimed in claim 11, wherein the outlet seal is formed from rubber.

* * * * *